US007278227B2

(12) United States Patent
Masoodifar

(10) Patent No.: US 7,278,227 B2
(45) Date of Patent: Oct. 9, 2007

(54) CONDITIONING SHOE AND METHOD OF USE

(76) Inventor: Eshrat Masoodifar, 3323 Bienville Ave. Apt. B, New Orleans, LA (US) 70119

( * ) Notice: Subject to any disclaimer, the term of this patent is extended or adjusted under 35 U.S.C. 154(b) by 314 days.

(21) Appl. No.: 10/860,799

(22) Filed: Jun. 2, 2004

(65) Prior Publication Data

US 2005/0246924 A1 Nov. 10, 2005

Related U.S. Application Data

(63) Continuation-in-part of application No. 29/202,133, filed on Mar. 26, 2004, and a continuation-in-part of application No. 10/647,146, filed on Aug. 4, 2003, now abandoned.

(51) Int. Cl.
*A43B 5/00* (2006.01)

(52) U.S. Cl. ..... 36/114; 36/25 R; 36/142; 36/103; 601/23; 482/79; 482/80

(58) Field of Classification Search ..... 36/114, 36/25 R, 103, 142–144; 601/23–26; 482/79, 482/80

See application file for complete search history.

(56) References Cited

U.S. PATENT DOCUMENTS

| | | | | | |
|---|---|---|---|---|---|
| 2,769,252 | A * | 11/1956 | Monier | 36/140 |
| 3,472,508 | A | 10/1969 | Baker et al. | |
| 4,206,558 | A | 6/1980 | Bivona | |
| 4,821,432 | A | 4/1989 | Reiber | |
| 5,088,481 | A * | 2/1992 | Darby | 602/23 |
| D325,121 | S | 4/1992 | Merchant | |
| 5,135,450 | A | 8/1992 | Smith, IV | |
| 5,197,932 | A | 3/1993 | Smith, IV | |
| 5,507,106 | A * | 4/1996 | Fox | 36/103 |
| 5,713,820 | A | 2/1998 | Carbone | |
| 5,826,351 | A * | 10/1998 | Tsuji | 36/25 R |
| 5,897,464 | A | 4/1999 | McLeod | |
| 5,974,699 | A * | 11/1999 | Park | 36/103 |
| D420,407 | S | 2/2000 | Garcia et al. | |
| 6,131,315 | A * | 10/2000 | Frye et al. | 36/132 |
| 6,393,735 | B1 * | 5/2002 | Berggren | 36/129 |
| 6,421,935 | B1 | 7/2002 | Barlett | |
| 6,698,050 | B1 * | 3/2004 | Frye | 12/133 R |

* cited by examiner

*Primary Examiner*—Marie Patterson
(74) *Attorney, Agent, or Firm*—Joseph T. Regard, Ltd plc

(57) ABSTRACT

An conditioning article of footwear for exercise, strength training, or physical therapy having a foot support platform with either straps or an upper shoe portion or the like to engage the foot, a sole having front and rear ends corresponding with the toes and heel of the foot, respectively, and a medial area there between, the sole having a spaced medial support portion having floor engaging surface generally parallel to the foot support platform, the medial support portion situated generally under the ball and (generally) arch of the user's foot. Situated forward the medial portion to the forward tip of the sole is an angled area having an angle of between, for example, 20-60 degrees. Situated behind the medial portion is a short angled area terminating in a thinner rear sole area running generally parallel with the foot platform, but having about fifty percent of the thickness of the medial area. The present footwear and method of use is configured to be positioned to one of five desired positions or attitudes with regard to the supporting surface, and contacted with the supporting surface in that position while in use, and not the rolling or pivotal use of prior systems.

56 Claims, 5 Drawing Sheets

CONDITIONING SHOE AND METHOD OF USE

STATEMENT OF CONTINUING APPLICATIONS

The present application is a Continuation in Part of U.S. Design patent application Ser. No. 29/202,133 filed Mar. 26, 2004 pending. The present application is also a Continuation in Part of U.S. patent application Ser. No. 10/647,146 filed Aug. 4, 2003 now abandoned.

TECHNICAL FIELD OF THE INVENTION

The present invention relates to exercise and therapeutic shoes, and in particular to a shoe which may be worn for all day/every day use and is easily positionable into a variety of postures to condition and exercise various aspects the musculoskeletal and cardiovascular system of the user, while assisting the user to further develop improved, coordination, balance and posture. The present shoe is useful in a variety of medical therapies, including preventing DVT and pulmonary embolisms, and is useful for hospital use in patients and other confined individuals.

The preferred embodiment of the present invention contemplates an article of footwear having a foot support platform with either straps or an upper shoe portion or the like to envelope the foot, and a sole having front and rear ends corresponding with the toes and heel of the foot, respectively, with a medial area there between, the sole having a spaced medial support portion having a floor engaging surface generally parallel to the foot support platform, the medial support portion situated generally under the ball and generally at least a portion of the arch of the user's foot.

Situated forward the medial portion to the front end of the sole is an angled area having an angle of between, for example, 20-60 degrees.

Situated behind the medial portion is a short angled area terminating in a thinner rear sole area running generally parallel with the foot platform, but having about fifty percent of the thickness of the medial area.

The present footwear is intended to be positioned to one of five desired positions or attitudes with regard to the supporting surface, and contacted with the supporting surface in that position while in use, i.e., while walking or standing, and is not intended to be utilized in a rolling or pivoting contact, i.e. from heel to toe, as one might walk with conventional footwear.

BACKGROUND OF THE INVENTION

The prior art contemplates many diverse shoes for various orthopedic, balance, or strength training purposes, but none as diverse or effective as the present system.

Many of these shoes include soles of various configurations which are configured to be rocked or pivoted by the user for exercise or conditioning, generally the ankle area. Examples include U.S. Pat. Nos. 3,472,508, 5,135,450, 5,197,932, 5,713,820, 5,897,464, Des 420,407 and U.S. Pat. No. 6,421,935.

U.S. Pat. No. 4,206,448 teaches a hyperbolic sole for use with an article of footwear for simulated jogging or the like.

U.S. Pat. No. 4,821,432 teaches a "walking adapter for postsurgical shoes" comprising a generally radially configured piece configured to engage a selected portion along the length of the sole of a shoe for therapy "to modify the pivotal axis of the sandal during walking".

Pat. No. Des 325,121 is a design for a "shoe sole" with no disclosure or teachings as to its use or application.

U.S. Pat. No. 6,131,315 relates to a "footwear exercising device" comprising a shoe having a raised forward sole area and reduced thickness heel area for conditioning the user, although it would appear that such a device would appear to be hard on the users joints.

Most of the exercise shoes of general relevance to the present invention appear to have been configured to be rocked or pivoted during use, for ankle area conditioning or the like.

Those that taught raised forward soles and reduced thickness heel areas were of different configuration to the present applied for invention, and apparently were utilized in a different fashion, for different results as well.

In summary, the prior art appears to be limited to specific use shoes which are intended to be utilized in a very limited, specialized context, and no shoe appears to contemplate or suggest a sole having a profile which allows a user to orient the sole in a variety of positions or orientations for conditioning, exercise, or treatment.

GENERAL SUMMARY DISCUSSION OF THE INVENTION

The present invention provides an article of footwear which may be worn alternatively in up to five different positions or attitudes for providing at least five different types of conditioning, thereby providing a shoe exercise system which is more effective, easier to use, and less expensive than the prior art, in a shoe which is more attractive and is able to be worn comfortably all day.

The preferred embodiment of the present shoe is easily positionable into a variety of postures to exercise various aspects the musculoskeletal system of the user, while assisting the user to further develop improved coordination, balance and posture, providing head to toe conditioning.

The present system could be incorporated in a variety of shoe styles and is envisioned as being utilized with every day footwear in a majority of shoes, and is contemplated as being revolutionary in its concept of use/conditioning in that by simply wearing the shoes in everyday use, the user is conditioning their body and improving posture, balance, coordination without even thinking about it.

The present invention contemplates an article of footwear having a foot support platform with either straps or an upper shoe portion or the like to engage the foot, and a sole having front and rear ends corresponding with the toes and heel of the foot, respectively, and a medial area there between, the sole having a spaced medial support portion having floor engaging surface generally parallel to the foot support platform, the medial support portion situated generally under the ball and forward arch portion of the user's foot.

Situated forward the medial portion to the forward tip of the sole is an angled area having an angle of between, for example, 20-60 degrees.

Situated behind the medial portion is a short angled area terminating in a thinner rear sole area running generally parallel with the foot platform, but having about fifty percent of the thickness of the medial area.

It is iterated that the materials, measurements and designs in the present system are exemplary, and the system can vary in style, configuration, material, and application.

Unlike the prior art, the present footwear is not configured for pivoting or rolling in use, but rather is intended to be positioned to one of five desired positions or attitudes with regard to the ground, and contacted with the ground in that position while walking or standing.

It is therefore an object of the present invention to provide an exercise shoe which may be worn in a variety of attitudes or positions to provide various different conditioning of the user.

It is another object of the present invention to provide a system for exercise utilizing an exercise, conditioning, or therapeutic sandal or shoe wherein the user may wear the shoe all day and perform alternative exercise routines by simply positioning the shoe in one of several positions as the user stands or walks about.

It is another object of the present invention to provide a method of exercising or conditioning utilizing an article of footwear shoe which is positionable in various positions and then engaging the ground in that position during walking or standing.

It is another object of the present invention to provide an exercise shoe or sandal configured to provide optimal conditioning of various diverse areas of the musculoskeletal, cardiovascular, lymphatic systems and the like, therapeutically conditioning the user, while improving the coordination, balance and posture of the user.

It is an object of the present invention to provide a therapeutic or conditioning shoe sole design which may be incorporated into footwear for everyday use, so that the wearer/user is exercising or otherwise being conditioned without even being aware of same, revolutionizing the concept of footwear.

Lastly, it is an object of the present invention to provide a method and system for conditioning and/or improving the balance or posture of a user utilizing an article of footwear which may be positioned in various positions vis a vis the ground for different types and/or degrees of conditioning.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1A:
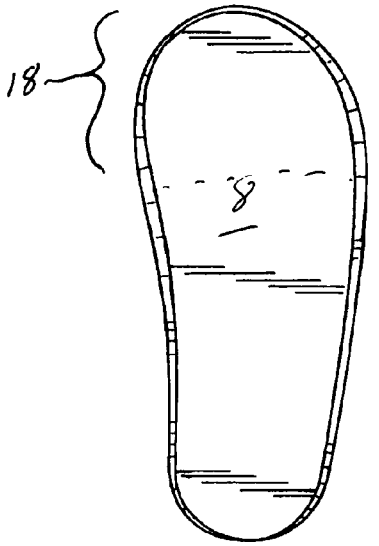
FIG. 1A is a top view of the shoe sole of the preferred embodiment of the present invention.
Figure 1B:
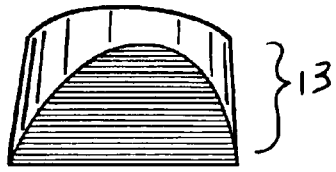
FIG. 1B is a front view of the shoe sole of FIG. 1A.
Figure 1C:
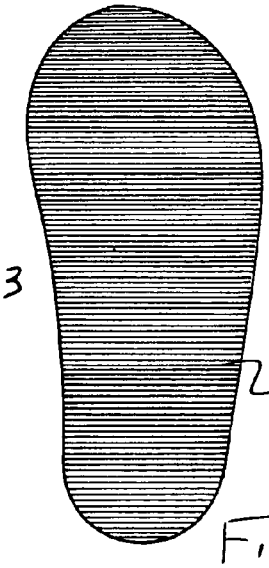
FIG. 1C is a bottom view of the shoe sole of FIG. 1A.
Figure 1D:
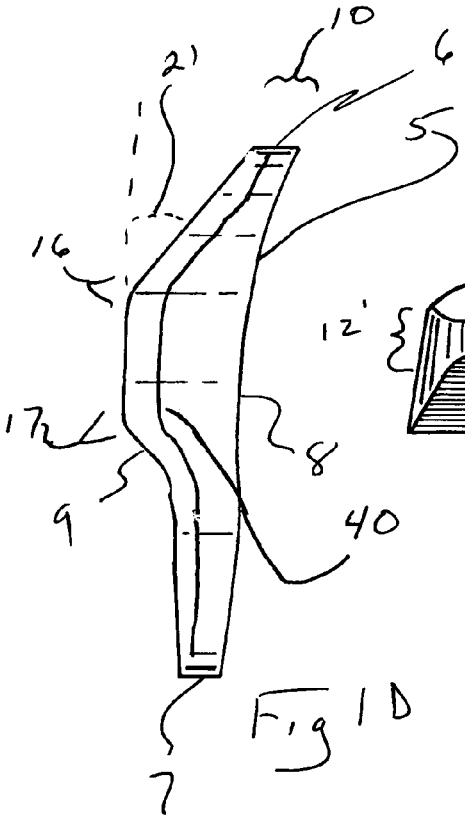
FIG. 1D is a side view of the first side of the shoe sole of FIG. 1A.
Figure 1E:
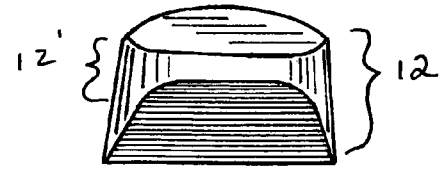
FIG. 1E is an rear end view of the shoe sole of FIG. 1A.
Figure 1F:
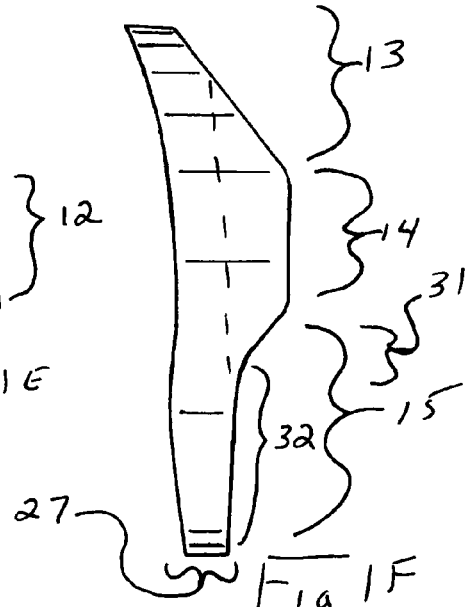
FIG. 1F is a side view of the second side of the shoe sole of FIG. 1A.

Referring to FIGS. 1A-1F, 3, 4, and 8, the footwear 2 of the exemplary embodiment of the present invention is shown as a pair of sandals, each sandal 1 having a foot bed or platform 3 for placement of the foot 20 of a user thereon, the foot secured to the platform via straps 4 or the like. The foot bed may be flat or may be curved to anatomically conform to the foot of the user. In addition to sandals, the present invention is intended to cover and works similarly with other forms of footwear, including shoes, boots, sandals, or other footwear forms for a variety of uses.

The shoe sole 5 of the present system has a unique configuration and implementation, as will be shown. The shoe sole 5 has a front, first end 6, a rear, second end 7, an upper surface 8 which can form the foot bed or serve as a base for the foot bed, and a lower, ground engaging surface 9. In the preferred embodiment, the lower ground engaging surface 9 has formed thereon a plurality of grooves 11 formed therein to render said surface less prone to slippage when in use.

The sole comprises three principle sectional configurations, namely, a front, forward angled portion 13 having increased thickness from the front end to the medial portion, a medial, raised portion 14 having generally uniform thickness, and a rear portion 15 having generally decreased thickness, each of which will be more particularly discussed below.

As shown, the front, first end 6 of the shoe has a tip which has a thickness 12' of about one inch; from there, the front, forward angled portion then increases in thickness at an angular 21 descent toward the heel of the show at, for example, about thirty degrees, the descent terminating at about two and one-half inch thickness at a point corresponding generally below the ball of the foot (or also generally below sesamoid bones of the great toe (also called big toe)) of the user.

The forward pivot point 16 is formed at the intersection of the medial, raised portion 14 and the forward angled portion 13, comprising the transitional area from the generally flat surface of the medial, raised portion 14 to the angled orientation of the forward angled portion 13.

The medial, raised portion 14 forms a support surface of generally equal thickness 10 relative to the foot platform, providing generally uniform support to the user's foot comprising a front line 23 running about below the ball or sesamoid bones 22 of the great toe of the user 19 to a rear line 24 running below about the navicular bone 26 of the user's foot, or an area 29 of the foot forward the shin 25 and lower leg portion, and extending to the ball of the foot. This orientation allows the user to support their weight upon the medial, raised portion while walking or standing, which supports the front of the foot 20 to the ball of the foot and generally at least a portion of the arch of the user, simulating the orientation one may have when climbing stairs or the like. This orientation thereby provides cardiovascular and lymphatic benefits, as well as building muscle and skeletal systems, while improving balance, coordination, and posture of the user, preventing blood stasis, and burning calories and sugar, as will be more fully described infra.

The raised, medial portion 14 terminates in a rear pivot point 17 where the sole thickness is reduced for a transitional, relatively short length 31 (for example, for size seven (U.S.) sandals, about 1.5 inches) at an ascending angle, for example, about 40 degrees, providing an area 32 of generally uniform, reduced sole thickness 27, and wherein the rear spaced portion 15 is unsupported by a surface, ground or floor 29 when the medial raised portion 14 engaged the surface, ground or floor 29, the rear spaced portion 15 spaced 28 there above, the rear spaced portion spaced 28 there above.

A shank or insert 40 comprising a sheet or formed, flat piece of relatively rigid material may be provided as a layer along the length of each shoe to enhance the rigidity of the shoe. Alternatively, the shank or insert 40 may be comprised of a springy material to enhance spring action of the shoe while in use.

The shoe sole itself may be formed of high density polymer foam, or may be formed of a variety of relatively light weight materials. Alternatively, the shoes can be weighted to enhance the workout when used in an exercise regimen.

In use, the user, having the footwear upon their feet, orients the sole to the desired supporting positions and maintains that position in standing, walking, or other activity. It is reiterated that, with the preferred method of the present invention, the chosen position is maintained during the activity, and the footwear is not pivoted as in prior art systems.

Figure 2A:
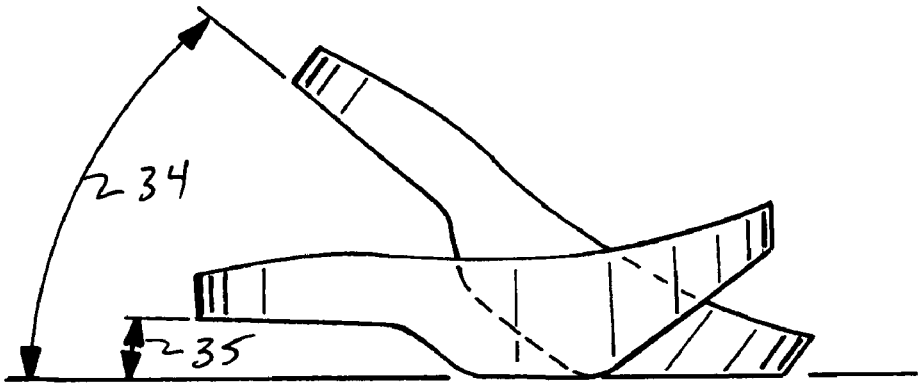
FIG. 2A is a side view of the shoe sole of FIG. 1A, illustrating the device alternatively positioned in the medial walking and forward exercising positions.
Figure 2B:
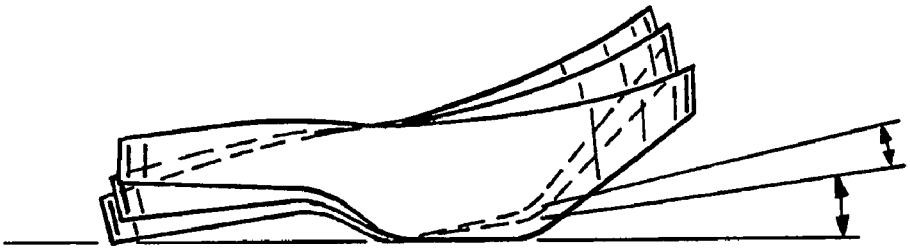
FIG. 2B is a side view of the shoe sole of FIG. 1A, illustrating the device alternatively positioned in the medial walking and rear exercise positions.
Figure 2C:
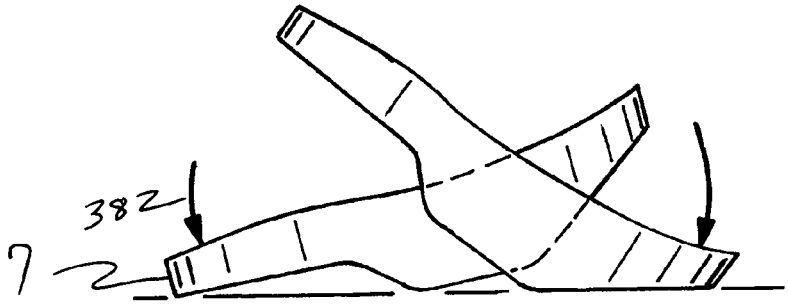
FIG. 2C is a side view of the shoe sole of FIG. 1A, illustrating the device alternatively positioned in the rear exercise and medial walking positions.
Figure 4:
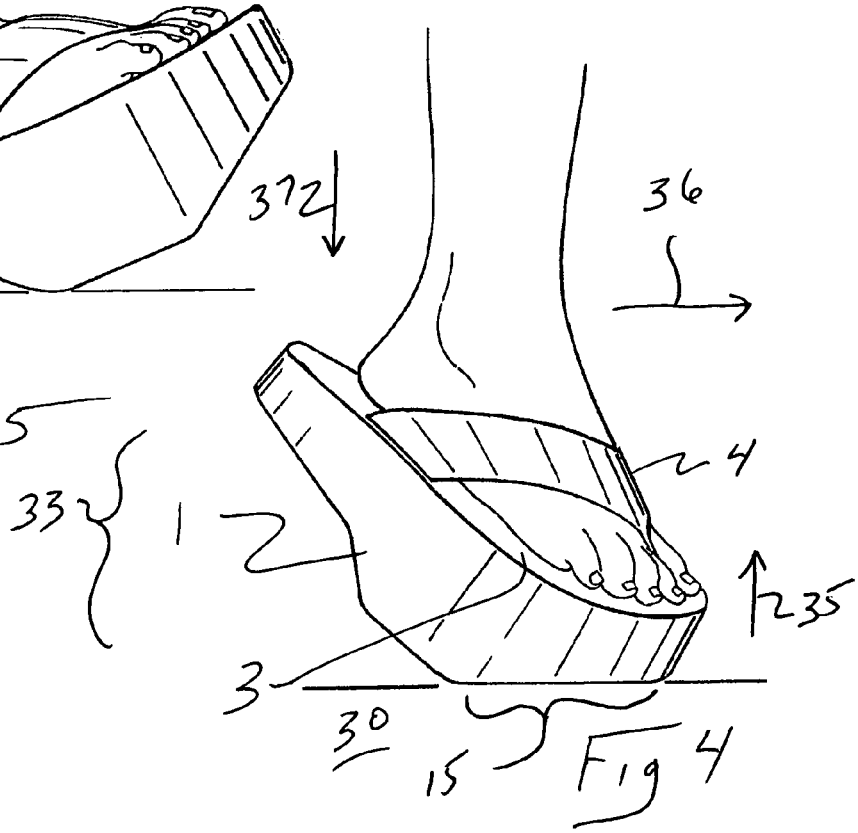
FIG. 4 is a side view of the sandals of FIG. 3 being utilized by a user in the forward exercise position.

Referring to FIGS. 2A, 2C and FIG. 4, the footwear is positioned 34 (by lifting the heel) in a frontal exercise posture 33 whereby the front, forward angled portion 15 contacts the floor, ground surface 30 or the like. This posture or shoe (sandal) orientation is referred to by the inventor as the ballerina or "swan walking" orientation, so as to concentrate the weight of the user on the arch/ball/metatarsals and phalanges/metatarsal joints of the feet, which exercises muscles including the gasterinimous, gluteus minimus and maximus, qudriceps, as well as facilitating circulation of the legs and thereby preventing DVT (economy class syndrome), varicosities, edema, and the like, while also urging the user to pull back their scapula and shoulders, thereby improving posture and alignment of the spine. In this position, the user can stand on one or both feet simultaneously, and can walk in this position by lifting 35 each shoe (sandal), repositioning 36 the leg and foot in a walking motion, lowering 37 and repositioning the shoe (sandal) so that the forward, angled portion 15 again contacts the ground, thereby "swan walking".

Figure 3:
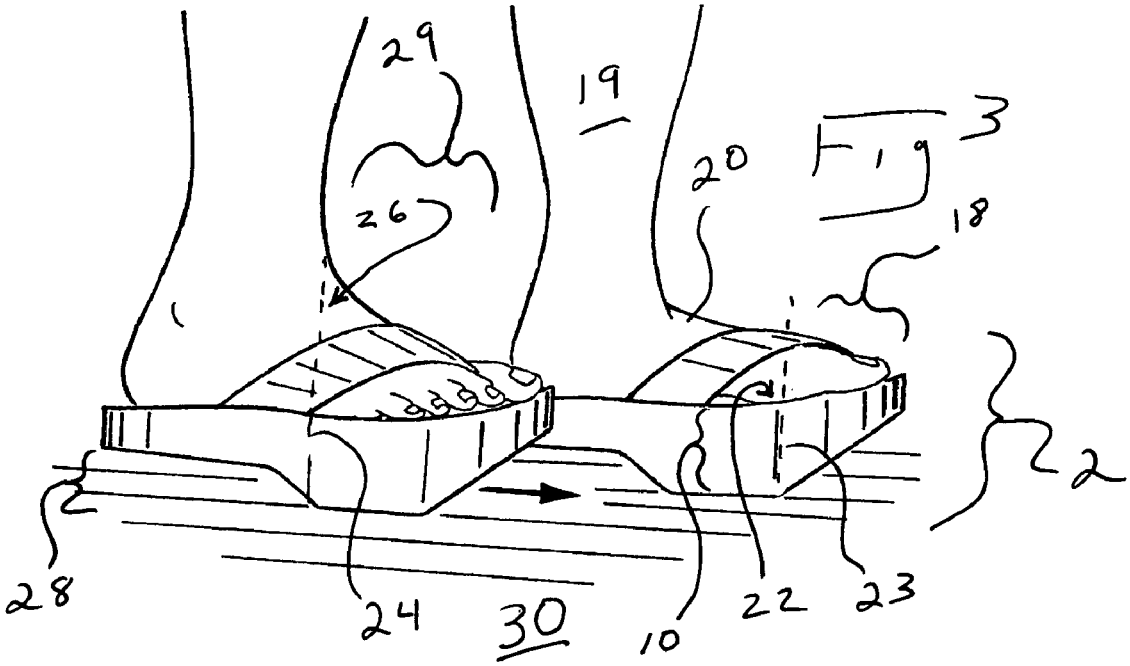
FIG. 3 is a side view of sandals incorporating the shoe sole of FIG. 1A being utilized by a user in the medial walking position.

Referring to FIGS. 3 and 2A, the second, "normal walking" orientation which nonetheless conditions the user comprises orienting the footwear so that the rear, spaced portion 15 of the sole is spaced 35 above the floor, and the medial, raised portion 14 fully or substantially contacts the floor, providing a relatively unstable platform for developing balance and coordination generally below the metatarsals, generally extending to at least a portion or the arch of the user, while requiring additional contracting of the muscles and circulatory system at the lower extremities during use, facilitating the pumping of blood against gravity, stimulating circulation not only of blood but also of the lymphatic system. In use in the "normal walking" orientation, the user 19 may walk or stand on the shoes, while maintaining the proper orientation when the footwear is contacting the supporting surface (floor). Unlike the "swan walk" position, where the metatarsals are at an angle with regard to the floor, in the "normal walking" position, the foot and metatarsals therein are situated at a generally horizontal, less stressful and more stable position relative to the floor.

Figure 5:
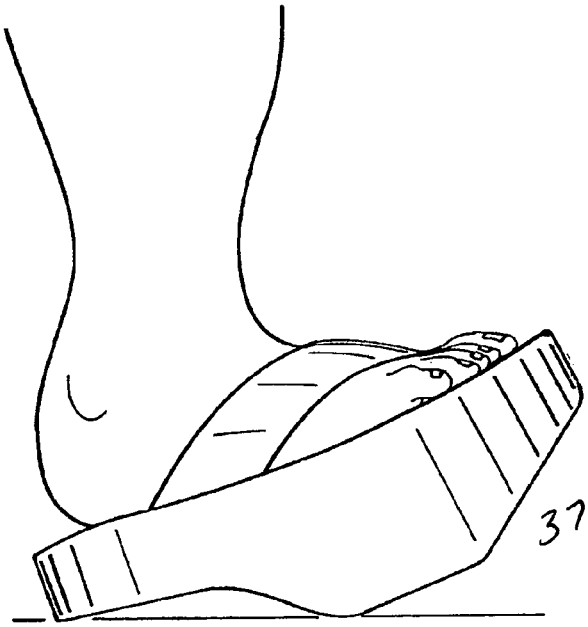
FIG. 5 is a side view of the sandals of FIG. 3 being utilized by a user in the rear exercise position.

Continuing with FIGS. 2B, 2C and FIG. 5, lowering 38 the heel or rear, second end 7 of the shoes so that the second end contacts the floor or support surface, and maintaining said position during walking or standing provides the "heel walking" orientation, which stretches the gastronomes and hamstring muscles.

Figure 6:
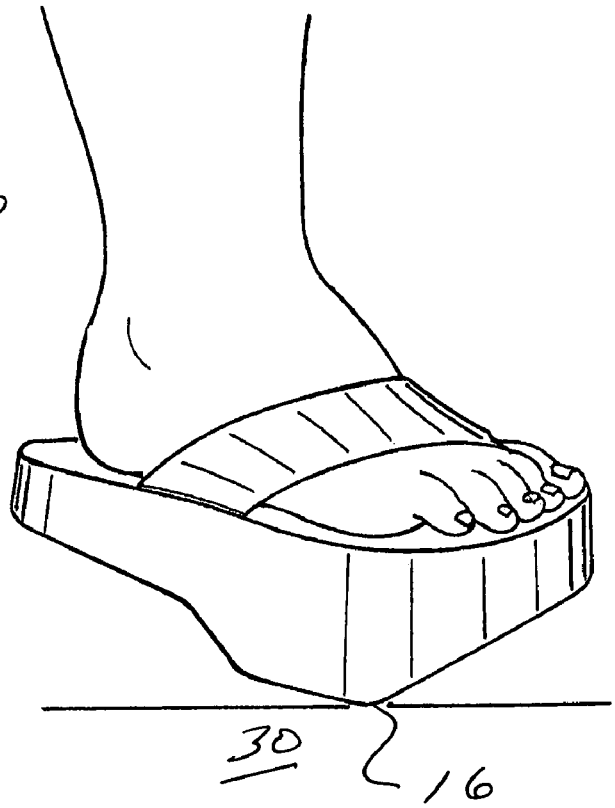
FIG. 6 is a side view of the sandals of FIG. 3 being utilized by the user in the front pivot point position.
Figure 7:
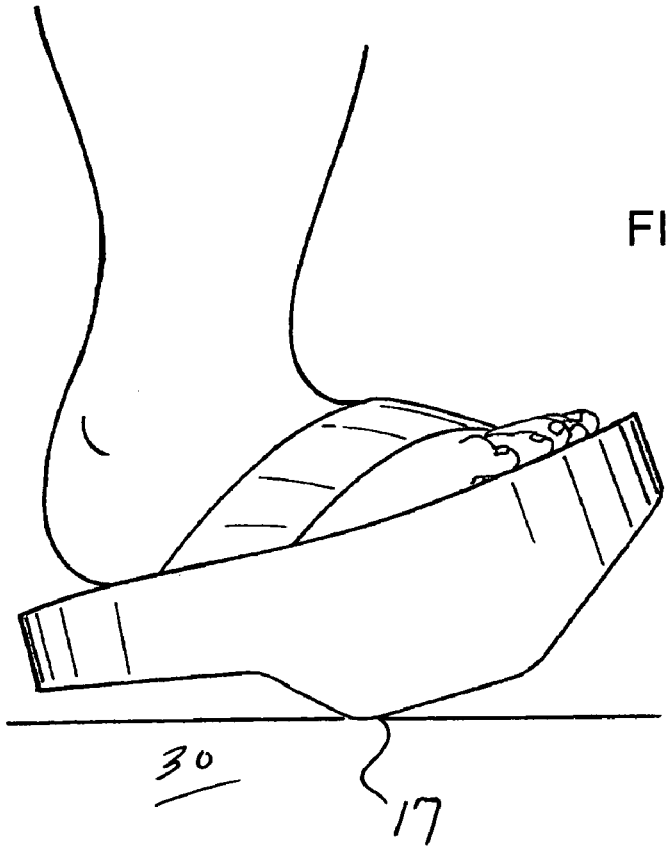
FIG. 7 is a side view of the sandals of FIG. 3 being utilized by the user in the rear pivot point position.
Figure 8:
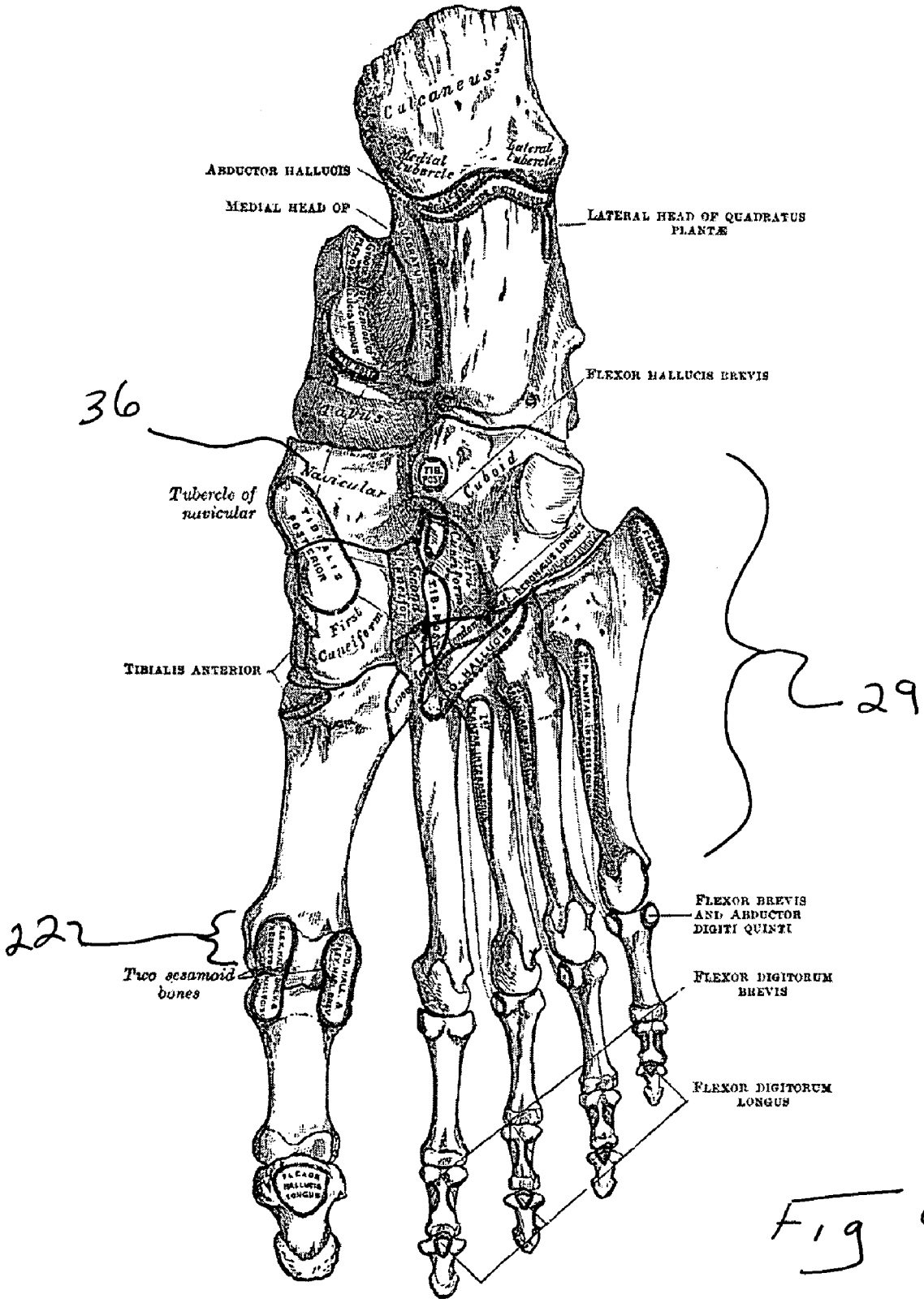
FIG. 8 is a plantar view of an anatomical sketch of the skeletal system of a right foot.

FIGS. 6 and 7 illustrates two balance positions which may be utilized with the system of the present invention. As shown in FIG. 6, the shoe may be oriented so that the forward pivot point 16 only contacts the floor 30 or support surface, which orientation is maintained during walking or standing, which enhances strength (via overcoming gravity), balance, coordination, and posture. After utilizing the footwear of the present invention for a period of time, standing, walking or running with conventional shoes becomes much less burdensome and provides the user with greater stamina and strength.

Alternatively, in FIG. 7, the user may orient the shoes to only contact the floor or other support surface 30 via the rear pivot point, which orientation is likewise maintained during walking or standing, which alternative orientation also enhances balance, coordination, and posture.

A method of the present invention may thereby be summarized as follows:

A method of conditioning, comprising the steps of:

a. providing an article of footwear for a user having a foot having metatarsals, a sesamoid bone and a navicular bone, comprising:
   i. a sole having first and second ends, a length, a top formed to engage the foot of a user, and a bottom formed to selectively contact a support surface, said bottom of said sole further having situated along its length a forward portion having a length, a medial portion having a length, and a rear portion, said medial area situated below and formed to support the metatarsals of the user, said medial portion further comprising first and second ends and the foot;
   ii. said medial portion of said sole having greater thickness than said forward and rear portions;
b. placing the footwear upon the foot of the user;
c. positioning said sole of the footwear such that said length of said medial area fully contacts the support surface, such that said forward area and said rear area of said sole are spaced above the support surface, whereby the user is supported by the users metatarsals, with said first end of said medial portion situated under said sesamoid bone, and said second end of said medial portion is situated under said navicular bone;
d. walking with said footwear, maintaining said orientation of said sole such that said length of said medial area fully contacts the support surface upon engaging the support surface, whereby the user is supported by the users metatarsals, and said forward area and said rear area of said sole are spaced above the support surface;
e. positioning said sole of the footwear such that said length of said forward area fully contacts the support surface, such that said medial area and said rear area of said sole are spaced above the support surface, whereby the user is supported by the users metatarsals in at an angled orientation; and
f. of walking with said foot, maintaining said orientation of said sole such that said length of said forward area fully contacts the support surface upon engaging the support surface, whereby the user is supported by the users metatarsals, and said medial area and said rear area of said sole are spaced above the support surface.

Additionally, as discussed, the user may balance upon the front and/or rear pivot points to provide conditioning and improve balance, coordination and posture.

Exemplary Specifications

For a size seven(US) shoe, exemplary specifications follow:

Length: 9.5 inches

Thickness of sole at front end: 1 inch

Length of forward angled portion

Distance of raised medial portion from front end: about 3 inches

Length of raised medial portion: about 2.25 inches

Width of raised medial portion at front: about 4.25 inches

Width of raised medial portion at rear: about 4.00 inches

Length of rear, spaced portion: about 4.25 inches

Elements of the Invention

| Element | Description |
|---|---|
| 1 | sandal |
| 2 | footwear |
| 3 | foot platform or bed |
| 4 | straps |
| 5 | shoe sole |
| 6 | front, first end |
| 7 | rear, second end |
| 8 | upper surface |
| 9 | lower, ground engaging surface |
| 10 | thickness |
| 11 | grooves (non-slip) |
| 12 | varying thickness |
| 13 | front, forward angled portion |
| 14 | medial, raised portion |
| 15 | rear, spaced portion |
| 16 | forward pivot point |
| 17 | rear pivot point |
| 18 | forward portion of foot from ball to toes |
| 19 | user |
| 20 | foot |
| 21 | about 30 degrees angle |
| 22 | sesamoid bones of the great or large toe |
| 23 | line forward pivot point |
| 24 | line rear pivot point |
| 25 | shin of user |
| 26 | navicular bone |
| 27 | reduced sole thickness |
| 28 | space |
| 29 | portion |
| 30 | floor |
| 31 | portion |
| 32 | tilts |
| 33 | frontal exercise posture (swan walking) |
| 34 | positioned |
| 35 | lifts |
| 36 | repositions |
| 37 | lowers |
| 38 | lowering |
| 39 | |
| 40 | shank |

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. An article of footwear for a user having a foot having metatarsals, comprising a sole having first and second ends, a length, a top formed to engage the foot of a user, and a bottom formed to selectively contact a support surface, said bottom of said sole further having situated along its length a forward portion having a length, said forward portion situated at an angle of about thirty degrees relative to said top of said sole, a medial portion having a generally uniform thickness and a length engaging said forward portion, a rear portion associated with said second end of said sole having a generally uniform thickness of about one-half of the thickness of said medial portion, said rear portion having a length corresponding to at least the length of said medial portion, and a transitional portion between said rear portion and said medial portion, said transitional portion situated at an angle of about forty degrees from said rear portion to said medial portion, said medial area situated below and formed to support the metatarsals of the user; said medial portion of said sole having greater thickness than said forward and rear portions; whereby, upon wearing the footwear and positioning said sole such that said length of said medial area fully contacts the support surface, said forward area and said rear area of said sole disengage the support surface, and the user is fully supported via the users metatarsals.

2. The invention of claim 1, wherein said medial portion has first and second ends and the foot of the user has a sesamoid bone of the great toe and a navicular bone, and wherein, when worn on the foot of the user, said first end of said medial portion is situated under said sesamoid bone, and said second end of said medial portion is situated under said navicular bone.

3. The invention of claim 2, wherein, there is provided a rear pivot point where said transitional portion and said medial portion engage.

4. The invention of claim 3, wherein, upon said footwear being placed upon the user's foot and the user orienting said sole such that said second end of said sole engages a flat ground surface and said rear pivot point engages said ground surface, no other portion of said sole engages said ground surface.

5. The invention of claim 4, wherein said footwear is a sandal having a foot engaging strap.

6. The invention of claim 4, wherein said footwear is a shoe.

7. The invention of claim 1, wherein said rear portion is uniformly spaced above the support surface when said medial portion fully contacts said support surface.

8. The invention of claim 7, wherein said forward portion is spaced above the support surface when said medial portion fully contacts said support surface.

9. The invention of claim 8, wherein there is provided a shank situated along the length of said sole to reinforce same.

10. The invention of claim 9, wherein said shank is formed of a sheet of rigid material.

11. The invention of claim 9, wherein said shank is formed of a sheet of springy material.

12. An article of footwear, comprising: a sole having first and second ends, a top, and a bottom; a footbed associated with said top of said sole; a ground engaging portion associated with said bottom of said sole; a raised medial portion having first and second ends, said raised medial portion situated at said bottom of said sole, said raised medial portion formed to selectively support the metatarsals of the user; a front portion situated forward said raised medial portion, said raised medial portion situated in the vicinity of said first end of said sole, said raised medial portion having a generally uniform thickness and a length formed to selectively support the phalanges of the user; a rear portion associated with said second end of said sole having a generally uniform thickness of about one-half of the thickness of said medial portion, said rear portion having a length corresponding to at least the length of said medial portion, and a transitional portion between said rear portion and said medial portion, said transitional portion situated at an angle of about forty degrees from said rear portion to said medial portion.

13. The invention of claim 12, wherein said medial portion has first and second ends and the foot of the user has a sesamoid bone of the great toe and a navicular bone, and wherein, when worn on the foot of the user, said first end of said medial portion is situated under said sesamoid bone, and said second end of said medial portion is situated under said navicular bone.

14. The invention of claim 13, wherein said bottom of said forward portion of said sole is situated at an angle relative to said top of said sole.

15. The invention of claim 14, wherein said angle is within a range of twenty to fifty degrees.

16. The invention of claim 15, wherein said angle is about 30 degrees.

17. The invention of claim 15, wherein said rear portion is uniformly spaced above the support surface when said medial portion fully contacts said support surface.

18. The invention of claim 17, wherein said forward portion is spaced above the support surface when said medial portion fully contacts said support surface.

19. The invention of claim 18, wherein there is provided a shank situated along the length of said sole to reinforce same.

20. The invention of claim 19, wherein said shank is formed of a sheet of rigid material.

21. The invention of claim 19, wherein said shank is formed of a sheet of springy material.

22. The invention of claim 18, wherein said rear portion has about fifty percent of the thickness of said medial portion.

23. The invention of claim 22, wherein said footwear is a sandal having a foot engaging strap.

24. The invention of claim 22, wherein said footwear is a shoe.

25. An conditioning shoe, comprising: a sole having a top, bottom, first and second ends, and a length; a footbed associated with said top of said sole; said bottom of said sole comprising a forward portion having an angled orientation relative said top of said sole; said bottom of said sole further comprising a raised medial portion engaging said forward portion; said bottom of said sole further comprising a heel portion engaging said raised medial portion; wherein said raised medial portion of said sole has a thickness greater than said heel portion or said forward portion of said sole, said heel portion associated with said second end of said sole, said heel portion having a generally uniform thickness of about one-half of the thickness of said medial portion, said heel portion having a length corresponding to at least the length of said medial portion, and a transitional portion between said heel portion and said medial portion, said transitional portion situated at an angle of about forty degrees from said heel portion to said medial portion; whereby, upon orienting said medial portion of said sole such that said medial portion substantially contacts the floor, said forward portion and said heel portion are situated in spaced relationship above the floor, with said heel portion generally uniformly spaced above the floor.

26. The invention of claim 25, wherein said medial portion has first and second ends and the foot of the user has a sesamoid bone of the great toe and a navicular bone, and wherein, when worn on the foot of the user, said first end of said medial portion is situated under said sesamoid bone, and said second end of said medial portion is situated under said navicular bone.

27. The invention of claim 26, wherein said bottom of said forward portion of said sole is situated at an angle relative to said top of said sole.

28. The invention of claim 27, wherein said heel portion has about fifty percent of the thickness of said medial portion and wherein, upon said footwear being placed upon the user's foot and the user orienting said sole such that said second end of said sole engages a flat ground surface and said heel pivot point engages said ground surface, no other portion of said sole engages said ground surface.

29. The invention of claim 27, wherein said angle is within a range of twenty to fifty degrees.

30. The invention of claim 29, wherein said footwear is a sandal having a foot engaging strap.

31. The invention of claim 29, wherein said footwear is a shoe.

32. The invention of claim 29, wherein said angle is about 30 degrees.

33. The invention of claim 29, wherein said heel portion is spaced above the floor when said medial portion fully contacts said floor.

34. The invention of claim 33, wherein said forward portion is spaced above the floor when said medial portion fully contacts said support surface.

35. The invention of claim 29, wherein there is provided a shank situated along the length of said sole to reinforce same.

36. The invention of claim 35, wherein said shank is formed of a sheet of rigid material.

37. The invention of claim 35, wherein said shank is formed of a sheet of springy material.

38. A method of conditioning, comprising the steps of: a. providing an article of footwear for a user having a foot having metatarsals, comprising: I. a sole having first and second ends, a length, a top formed to engage the foot of a user, and a bottom formed to selectively contact a support surface, said bottom of said sole further having situated along its length a forward portion having a length, an elevated medial portion having a length and a generally uniform thickness, and a rear portion, said rear portion having a length at least as long as said media portion, said rear portion having a uniform thickness about one half of said medial portion, said medial area situated below and formed to support the metatarsals of the user; ii. said medial portion of said sole having greater thickness than said forward and rear portions; b. placing the footwear upon the foot of the user; c. positioning said sole of the footwear such that said length of said medial area fully contacts the support surface, such that said forward area and said rear area of said sole are spaced above the support surface, whereby the user is supported by the users metatarsals, and wherein said rear portion of is spaced above said support surface a generally uniform distance.

39. The method of claim 38, whereby there is further provided after step "c." the additional step "d." of walking with said foot, maintaining said orientation of said sole such that said length of said medial area fully contacts the support surface upon engaging the support surface, whereby the user is supported by the users metatarsals, and said forward area and said rear area of said sole are spaced above the support surface, and said rear portion is spaced above said support surface a generally uniform distance.

40. The method of claim 39, whereby said support surface is the floor.

41. The method of claim 39, whereby in step "a" said medial portion has first and second ends and the foot of the user has a sesamoid bone of the great toe and a navicular bone, and wherein, in step "c." said first end of said medial portion is situated under said sesamoid bone, and said second end of said medial portion is situated under said navicular bone.

42. The method of claim 41, wherein in step "a." said bottom of said forward portion of said sole is situated at an angle relative to said top of said sole.

43. The method of claim 42, wherein said angle is within a range of twenty to fifty degrees.

44. The method of claim 43, wherein said angle is about 30 degrees.

45. The method of claim 44, wherein in step "c." said rear portion is spaced above the floor when said medial portion fully contacts said floor.

46. The method of claim 45, wherein in step "c." said forward portion is spaced above the floor when said medial portion fully contacts said support surface.

47. The method of claim 38, wherein there is provided after step "c" the further step "d." of positioning said sole of the footwear such that said length of said forward area fully contacts the support surface, such that said medial area and said rear area of said sole are spaced above the support surface, whereby the user is supported by the users metatarsals in at an angled orientation.

48. The method of claim 47, wherein there is further provided after step "d." the additional step "e." of walking with said foot, maintaining said orientation of said sole such that said length of said forward area fully contacts the support surface upon engaging the support surface, whereby the user is supported by the users metatarsals, and said medial area and said rear area of said sole are spaced above the support surface.

49. The method of claim 48, wherein there is further provided after step "e" the further step "f." of positioning said sole of the footwear such that said heel area contacts the support surface, such that said medial area and said front area of said sole are spaced above the support surface, whereby the user is supported by the users heel in at an angled orientation.

50. The method of claim 49, wherein there is further provided after step "f." the additional step "g." of walling with said foot, maintaining said orientation of said sole such that said heel area contacts the support surface upon engaging the support surface, whereby the user is supported by the users heel, and said medial area and said front area of said sole are spaced above the support surface.

51. The method of claim 48, wherein in step "a" there is further provided a front pivot point formed in the bottom of said sole at the intersection of said forward area and said medial area of said sole.

52. The method of claim 51, wherein in step "a" there is further provided a rear pivot point formed in the bottom of said sole at the intersection of said medial area and said rear area of said sole.

53. The method of claim 51, wherein there is further provided after step "e" the additional step "f" of orienting said sole such that said user is balanced upon said front pivot point, and balancing upon said front pivot point for a period of time.

54. The method of claim 53, wherein there is further provided after step "f" the additional step "g" of orienting said sole such that said user is balanced upon said rear pivot point, and balancing upon said rear pivot point for a period of time.

55. The method of claim 54, wherein there is further provided after step "g" the additional step "h" of walking with said foot, maintaining said orientation of said sole such that said user is balanced upon said front pivot point while said sole contacts the support surface.

56. The method of claim 55, wherein there if further provided after step "h" the additional step "I" of walking with said foot, maintaining said orientation of said sole such that said user is balanced upon said rear pivot point while said sole contacts the support surface.

* * * * *